US005822808A

United States Patent [19]

Esser

[11] Patent Number: 5,822,808

[45] Date of Patent: Oct. 20, 1998

[54] HYDROMASSAGE DEVICE FOR USE IN A BATHTUB

[75] Inventor: Hans-Peter Esser, Frechen, Germany

[73] Assignee: Hoesch Metall + Kunststoffwerk GmbH, Kreuzau, Germany

[21] Appl. No.: 624,502

[22] PCT Filed: Aug. 2, 1995

[86] PCT No.: PCT/EP95/03083

§ 371 Date: Jul. 22, 1996

§ 102(e) Date: Jul. 22, 1996

[87] PCT Pub. No.: WO96/03960

PCT Pub. Date: Feb. 15, 1996

[30] Foreign Application Priority Data

Aug. 5, 1994 [DE] Germany ..... 94 12 640 U
Mar. 23, 1995 [DE] Germany ..... 195 10 645.8

[51] Int. Cl.[6] ..... A47K 3/00

[52] U.S. Cl. ..... 4/541.1; 4/559

[58] Field of Search ..... 4/559, 541.1–541.5; 601/167

[56] References Cited

U.S. PATENT DOCUMENTS 4,282,866 8/1981 Miffitt ..... 4/541.3 X
5,067,481 11/1991 Bucher ..... 601/167
5,195,511 3/1993 Kodato et al. .
5,197,153 3/1993 Hara .

FOREIGN PATENT DOCUMENTS 0131273 1/1985 European Pat. Off. .
4004801 8/1990 Germany .

*Primary Examiner*—Charles E. Phillips
*Attorney, Agent, or Firm*—Spencer & Frank

[57] ABSTRACT

A hydromassage device for use in a bathtub includes a battery casing to hold electrical batteries, preferably chargeable batteries, which are connected to a drive motor for a pump, where a pump casing, a motor casing and a battery casing are connected to one another and at least one of the casings is equipped with a holding arrangement for attaching the device to the wall of the tub. The battery casing and the motor casing are separate, detachably connected waterproof casings, the battery casing and the motor casing having on their outer walls contact members forming contacts with each other when in the operating state the two casings are connected to each other, in each casing forming contact pairs, to which the batteries or the drive motor are connected. In the operating state, at least one sealing arrangement gives the region of the contact pairs a waterproof seal.

19 Claims, 7 Drawing Sheets

Figure 1:
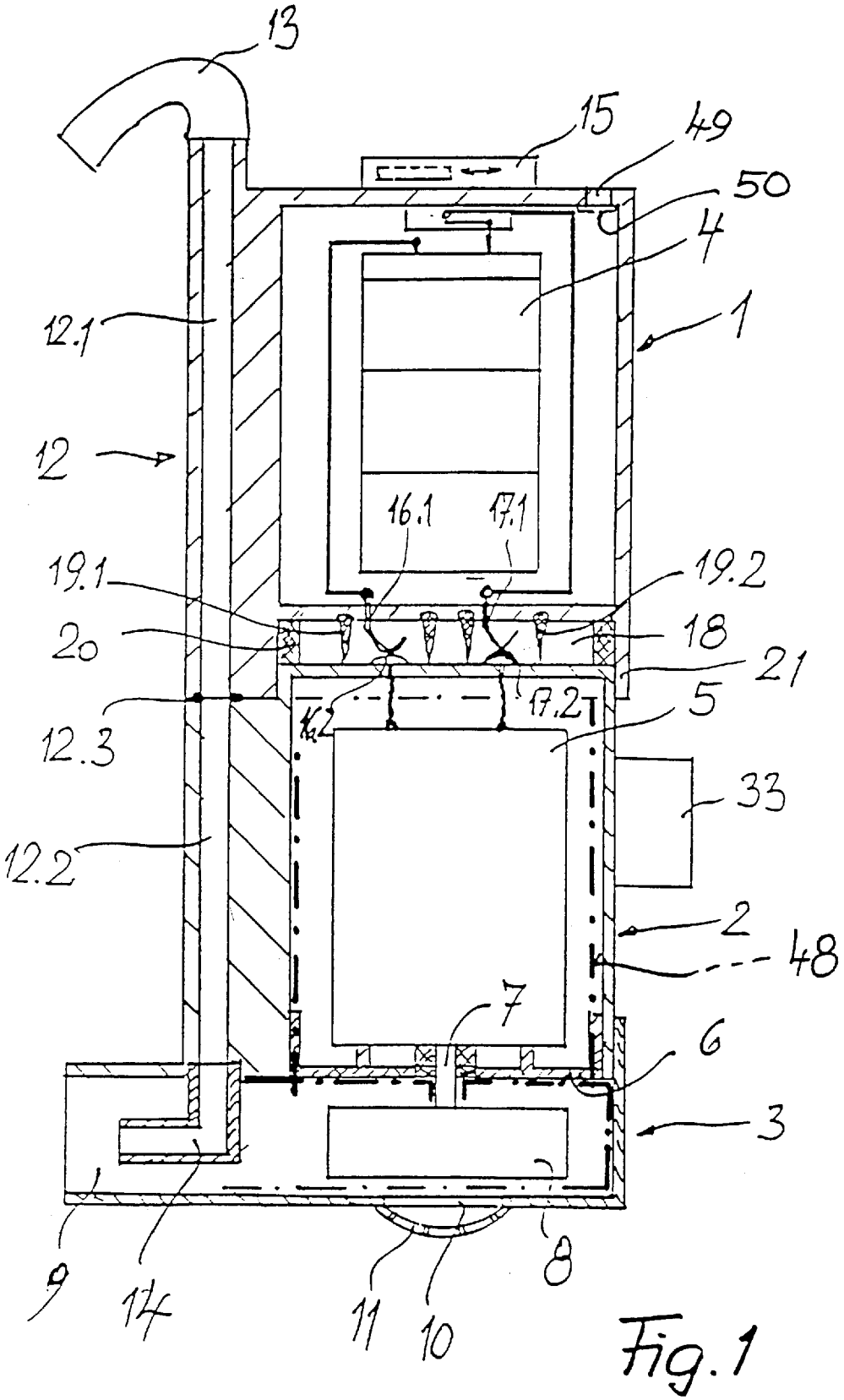

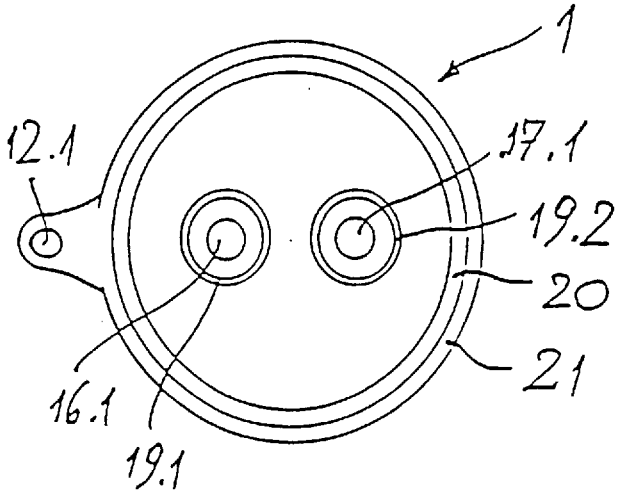
Fig. 2
Fig. 5
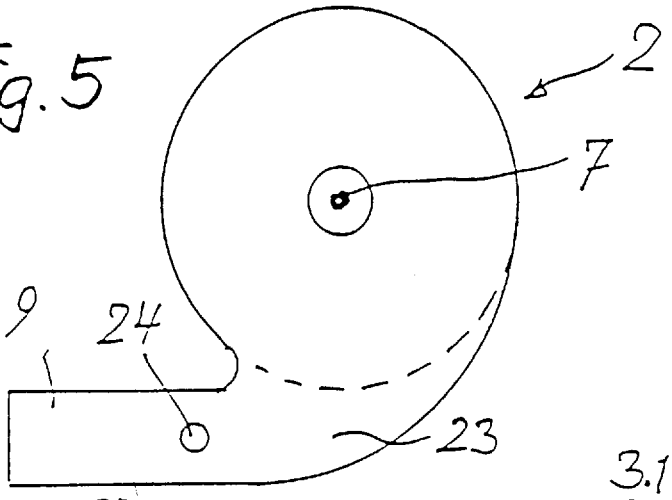
Fig. 7
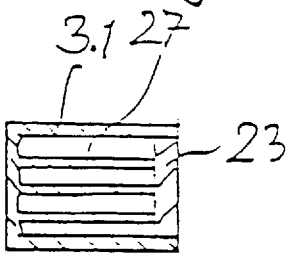
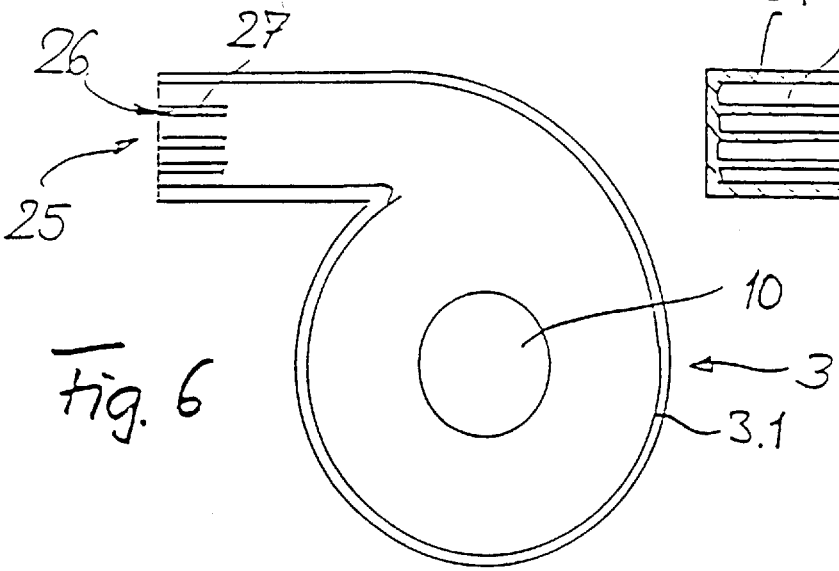
Fig. 6

HYDROMASSAGE DEVICE FOR USE IN A BATHTUB

DESCRIPTION:

The invention relates to a hydromassage device for use in a bathtub, having a pump casing which is connected to at least one intake aperture and to at least one nozzle-shaped discharge aperture and in which a pump impeller is seated, and having a motor casing in which an electric drive motor is arranged that is connected to the pump impeller, and further having a battery casing in which batteries, preferably chargeable batteries, are arranged which are connected to the drive motor, with pump casing, motor casing and battery casing being connected with one another and at least one of the casings being provided with holding means for securing the device to the wall of the tub.

A hydromassage device of the type described above is known from the German Patent 40 04 801. In the prior art hydromassage device, the motor casing and the battery casing are embodied so as to be fixedly connected to one another in one piece and they are in open connection with one another. The batteries are charged via terminal contacts guided toward the outside which can be connected to the charger via a plug. This process includes the risk that the user will leave the charger in the tub, possibly also in a filled tub, and will connect the hydromassage device to the charger in the event of a diminishing battery charge and will thereby attempt to maintain the operation directly by means of a power supply through the charger. Even if a charger is separated galvanically from the 220 Volt voltage supply, there still exists the danger of an electric shock in the presence of possible defects of the charger. A further drawback of the prior art arrangement is that, for replacing the batteries, the combined motor-battery casing must be opened and that, after a battery replacement, water may enter the motor casing as well as the battery casing if the seal is defective so that the device as a whole may be destroyed.

It is the object of the invention to embody a hydromassage device of the above-mentioned type such that the device as a whole meets stricter safety requirements.

According to the invention, this object is solved in that the battery casing and the motor casing are each formed by separate, waterproof casings, which are detachably connected with one another, that, on their outside wall, the battery casing and the motor casing are respectively provided with electrical contact members which are in contact with one another when, in the operating state, both casings are connected with one another and which respectively form a contact pair with which the batteries or the drive motor are connected, and that, in the operating state, the region of the contact pairs is sealed by at least one sealing arrangement so as to be waterproof. This arrangement has the advantage that the battery casing as well as the motor casing, each by itself, are embodied to be waterproof so that the user cannot open the casings themselves neither for charging nor for replacing the batteries and that thus the original factory seal of the individual elements cannot be cancelled by the user. For charging the batteries, the battery casing must be detached and must be connected directly to the charger outside of the tub. Charging takes place via the same contact members that respectively form the contact pairs in the operating state with the contact members of the motor casing. A further advantage of the arrangement according to the invention is that the user does not have to replace the batteries himself but that a factory-manufactured complete battery casing including batteries can always be made available to him.

This battery casing can then respectively be supplied with all of the elements which can wear out if they are frequently detached for charging such as, for example, the sealing arrangement or the means for detachably connecting the two casings with one another. In contrast, the motor casing and the pump casing can be embodied as one piece so that a hermetic seal of the motor casing is provided here as well, which seal only has an opening for the shaft passage or the seating of the pump impeller. This passage is then also factory-sealed, with this seal not being accessible to the user for normal use.

While it is possible, in principle, to seal the gap which closes the two contact pairs between battery casing and motor casing by means of a seal, it is provided as a particularly advantageous embodiment of the invention that each contact pair can be sealed by itself via a sealing arrangement so as to be waterproof. This arrangement has the advantage that, even if water enters into the gap between battery casing and motor casing, the separate sealing of each contact pair practically rules out a short circuit. It is advisable if, in addition to the sealing arrangements which seal each contact pair by itself as a primary seal, a further sealing arrangement is provided which seals the gap between battery casing and motor casing as a whole in the form of a secondary seal. This increases safety.

In an advisable embodiment of the invention it is further provided that the battery casing and the motor casing can be connected with one another by means of a latch connection. Such a latch connection, for example, embodied in the manner of a bayonet lock, offering, preferably in the form of a "coded" design of the elements forming the latch connection, a definitive allocation of the casings that are to be connected with one another, gives the assurance that in the latched position, i. e., in the operating state, the contact members of the contact pairs respectively are in contact with one another. An operating error as it may occur, for example, in a screw connection is thus ruled out. The "coding" may be achieved by the position and/or the dimensions of the elements of the latch connection.

In a further embodiment of the invention it is provided that at least the motor casing is equipped with an air intake pipe which ends in the region of the nozzle-shaped discharge aperture. Here, it is advisable if the air intake pipe is integrated into the design of the motor casing. Via a corresponding attachment, an extension in the form of a flexible tube or pipe can also be fitted to the end of the air intake pipe, which tube or pipe can be guided beyond the edge of the tub and can be secured there. This ensures that air is always drawn in during the operation. Advisably, the attachment at the tub edge is such that the intake aperture ends downward against the edge of the tub. This has the advantage that water cannot splash into the bathroom if, through carelessness, the nozzle-shaped discharge aperture of the pump casing is closed off, for example, by a cloth or by hand.

In an advisable embodiment of the invention it is further provided that the air intake pipe is guided on the outside of the motor casing and on the outside of the battery casing and is divided in the connecting region between motor casing and battery casing. This arrangement has the advantage that, depending on the dimensions of the overall arrangement, the intake aperture of the air intake pipe is already formed by the end which is guided out of the battery casing, with the aperture of the air intake pipe which is guided out of the battery casing then being disposed at a sufficient distance above the water level of the tub filling. By angling the free end of the air intake pipe guided out of the battery casing, it can also be ensured here that the water that is pushed out through the air intake pipe splashes directly into the tub when the nozzle-shaped discharge aperture on the pump casing is closed. Since the air intake pipe is guided on the outside of both the motor casing and the battery casing, it is ensured that the sealed gap between battery casing and motor casing, in which gap the contact pairs are arranged, does not have an opening in its tight seal vis-a-vis the surroundings.

It is advisable for the dividing point of the air intake pipe in the operating state to be sealed against the outside via a sealing arrangement. This ensures that only air is drawn into the nozzle-shaped discharge aperture via the air intake pipe.

In further embodying the invention it is provided that the pump casing is embodied in two sections, with one section being connected in a material-to-material bonding with the motor casing. This design allows a particularly advantageous manufacture and assembly. Advisably, the casings are injection-molded from a plastic material so that the end face of the motor casing facing the pump casing can already be designed such that it forms the complete pump casing in cooperation with the placed on top section of the pump casing. Here, the second section which is placed on top can be connected with the section disposed on the motor casing by means of a mechanical connection, bonding or welding after the pump impeller is mounted on the motor shaft. Here, it is advisable if, on the section of the pump casing that is connected to the motor casing by way of material-to-material bonding, the leadthrough of the motor shaft is embodied as end shield to which the motor is attached at the same time so that, during assembly, the end shield provided with the motor and, optionally, also with the assembled rotor, can be inserted into the motor casing and can be connected with the same in a waterproof and fixed manner by way of mechanical connecting means, by bonding or welding.

In another embodiment of the invention it is provided that the pump casing is embodied so as to be pivotable relative to the motor casing in the rotary plane of the pump impeller. This embodiment allows the jet orientation to be changed individually as desired by pivoting the pump casing when the hydromassage device is placed into the tub. If the pump casing is fixedly connected to the motor casing, a pivotably seated discharge nozzle can be provided instead in the region of the nozzle-shaped discharge aperture of the pump casing.

In embodying the invention, it is provided that the holding means is formed by at least one elastic suction cup which is connected via a holding rail to one of the casing elements, preferably to the motor casing. The embodiment of the holding means as suction cup is the simplest solution for attaching the hydromassage device to the tub wall. Since the holding means is preferably connected to the motor casing, there is the advantageous option that the hydromassage device can be left in the bathtub when the battery casing must be detached for charging the batteries.

In another embodiment it is provided that the casing is detachably connected to the holding rail. It is particularly advantageous if the casing is connected to the holding rail so as to be movable with respect to the latter. Here, the casing can be connected to the holding rail so as to be pivotable and/or displaceable so that the user has a variety of options to independently set the jet orientation. It is also advisable for the holding rail to be embodied in the manner of a telescope so that its length can be changed. This offers the option to set the holding rail to different tub dimensions and/or tub contours.

In a further embodiment of the invention it is provided that, as a switch, at least one reed switch is arranged on one of the casings, preferably on the battery casing, with the reed switch being operable via a sliding magnet. The arrangement of a reed switch has the advantage that a contactless operation of the reeds is possible via the sliding magnet and that, in this manner, any passage through the wall of the casing is avoided and, accordingly, sealing problems are prevented. Furthermore, the arrangement of the reed switch on the battery casing offers the advantage that if the battery set is replaced, which advisably is done by replacing a complete battery casing, a new, unused switch is also available at the same time, since switches of this type have a limited service life in view of the albeit high number of contact floats.

In further embodying the invention it is provided that the motor casing is embodied to be at least partially double-walled and that the gap between the inner wall and the outside wall is provided with an inlet aperture and is connected to the pump intake, with the inner wall enclosing the motor in a waterproof manner. This arrangement has the advantage that the motor can be cooled to a certain degree, even if the water contained in the tub is heated.

Figure 3:
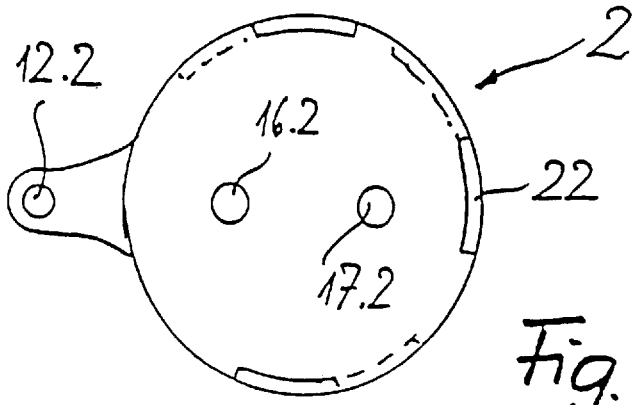
Figure 4:
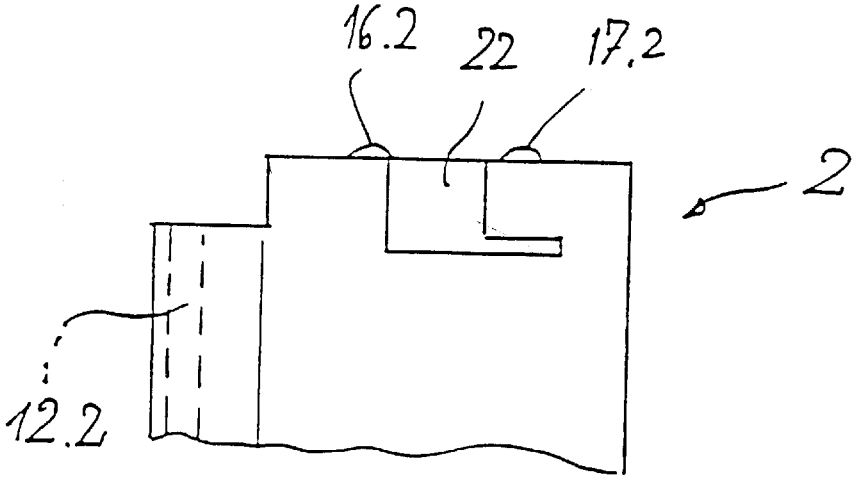
Figure 8:
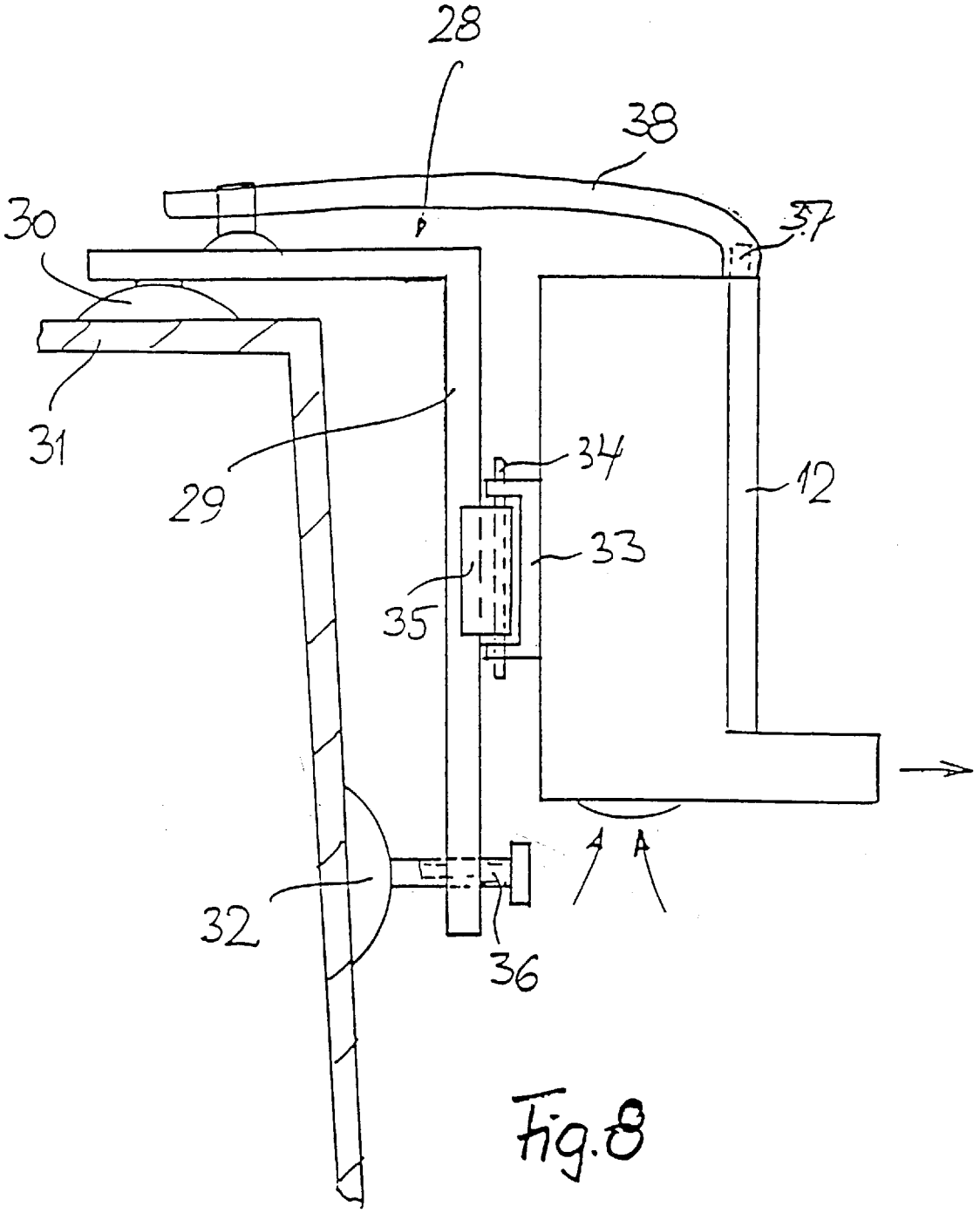
Figure 9:
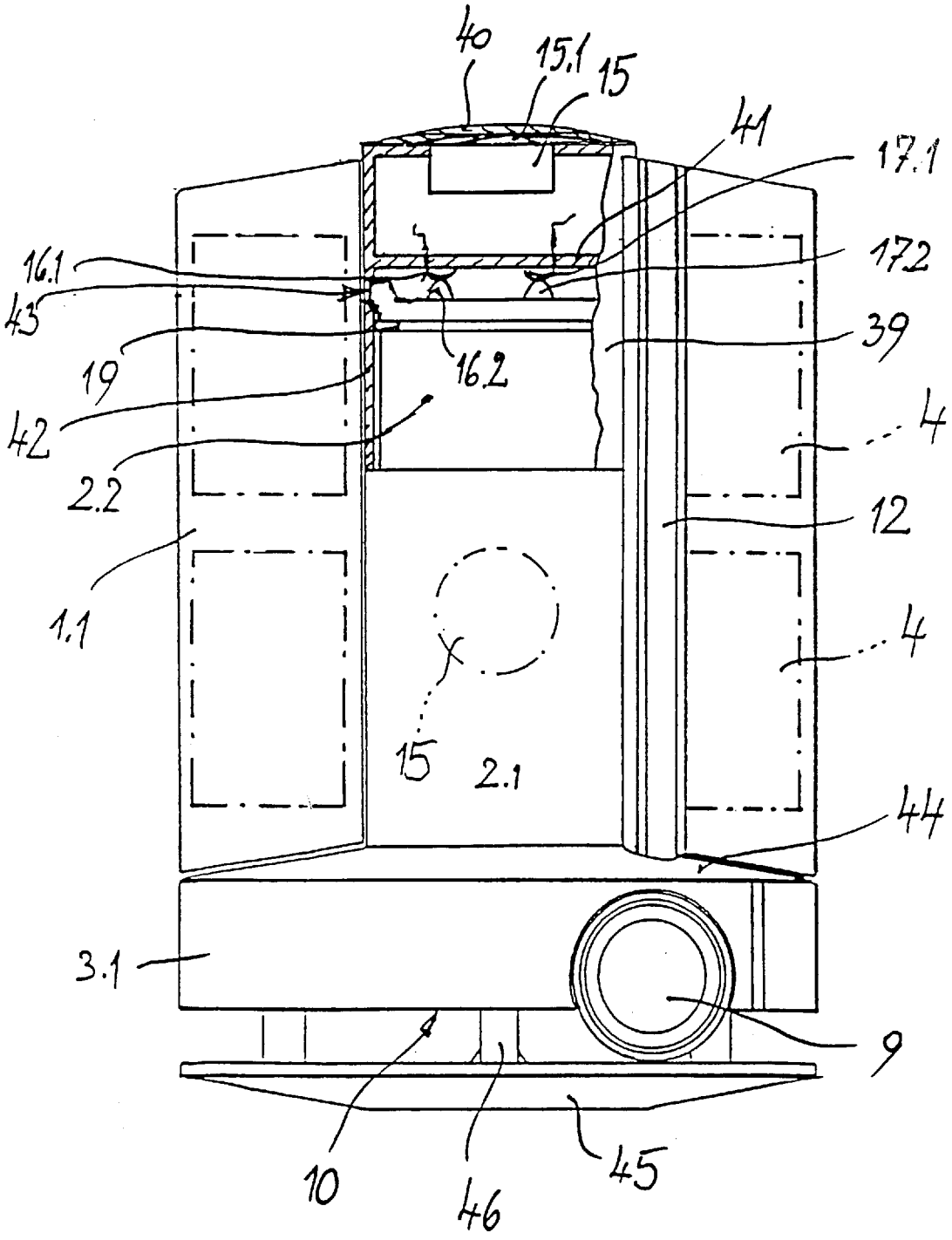
Figure 10:
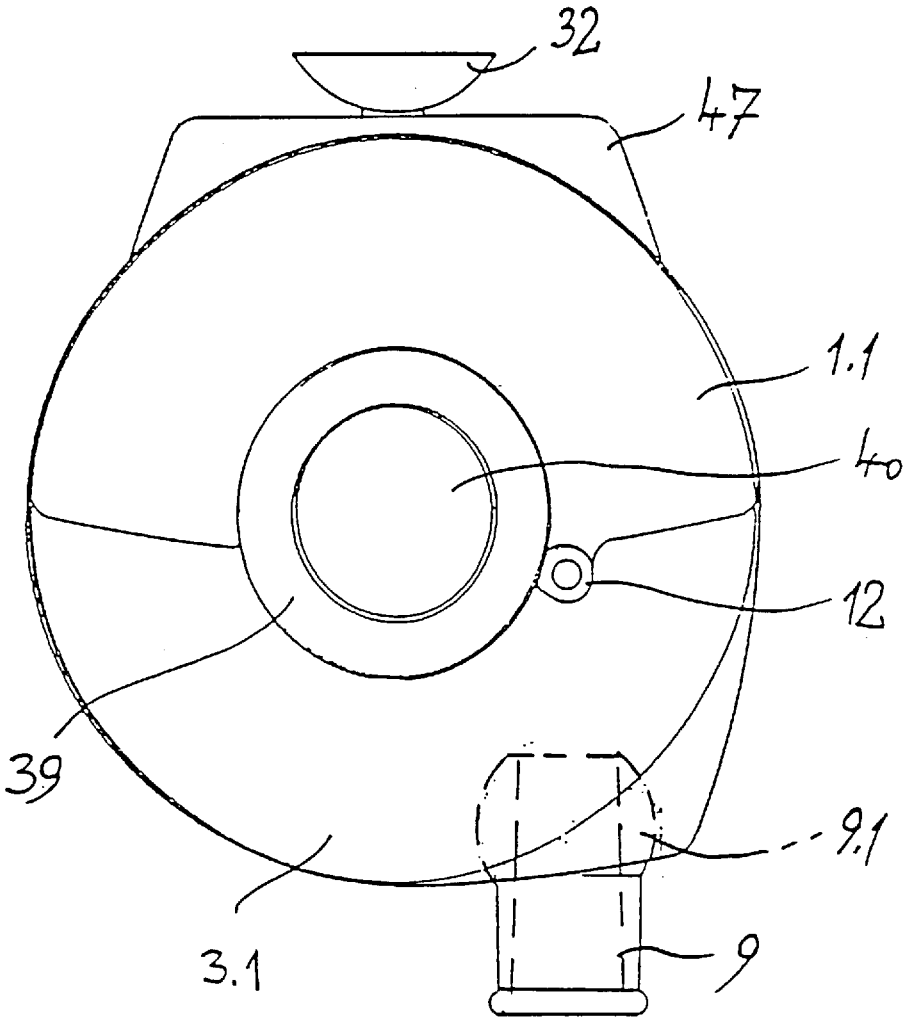
Figure 11:
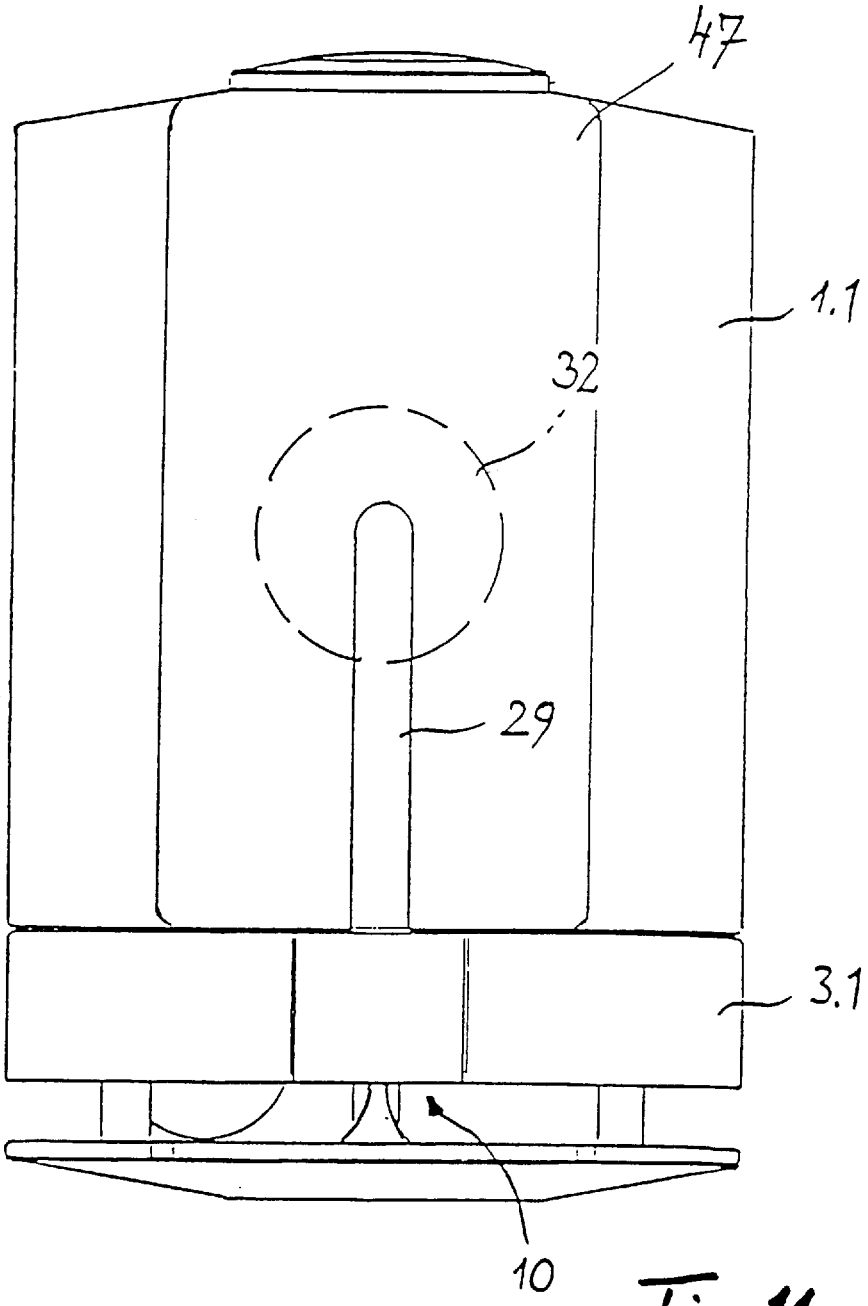

The invention is explained in greater detail by way of embodiments with reference to schematic drawings. These show:

| | |
|---|---|
| FIG. 1 | a vertical section, |
| FIG. 2 | a plan view of the battery casing in the contact region, |
| FIG. 3 | a plan view of the motor casing in the contact region, |
| FIG. 4 | a side view of the motor casing in the connecting region toward the battery casing, |
| FIG. 5 | in a pump casing which is embodied in two sections, a front view of the motor casing with a portion of the pump casing, |
| FIG. 6 | a front view of the side of the pump casing facing the motor casing, |
| FIG. 7 | a section through the nozzle-shaped discharge aperture according to line VII-VII in FIG. 6, |
| FIG. 8 | a side view of an embodiment of a holding means, |
| FIG. 9 | an embodiment, partially cut, |
| FIG. 10 | the embodiment according to FIG. 9 in a plan view, |
| FIG. 11 | the embodiment according to FIG. 9 in a rear view. |

As is shown in the sectional representation in FIG. 1, the hydromassage device is essentially composed of two sections, namely a battery casing 1 and a motor casing 2 to which a pump casing 3 is fixedly connected. A preferably rechargeable battery arrangement 4 is housed in the battery casing 1, which battery arrangement may be comprised of several individual cells. For the application intended here, for example, a battery set of eight individual cells, each with 1.2 volt, is provided having a charge of 1700 mAh so that an output of approx. 35 Watt is available at a total voltage of 9.6 volt and a current of 6 ampere.

An electric motor 5 is arranged in the motor casing 2, with the output of the motor being matched to the battery unit 4. Here, the motor 5 is connected to an end shield 6 which simultaneously forms the end face of the motor casing 2 facing the pump casing 3. The drive shaft 7 of the electric motor 5 is guided through the end shield 6 in a sealed manner and is connected to a pump impeller 8.

In the embodiment illustrated here, the pump casing 3 and the pump impeller 8 are designed as centrifugal pump so that a channel-like, nozzle-shaped discharge aperture 9 tangentially adjoins the pump casing 3. Here, the pump casing 3 is provided on its end face with a central intake aperture 10 which is covered by a protective basket 11 so that water from the tub can be drawn in through the rotating pump impeller 8 and can be discharged back into the tub in the form of a strong water jet via the nozzle-shaped discharge aperture 9.

On the motor casing 2 and on the battery casing 1, an air intake pipe 12 is arranged advisably on the outside which pipe is guided beyond the top in the region of the battery casing 1; the air intake pipe can either be connected with a tube which can be guided to the outside of the tub or it can be provided with a downwardly curved intake fitting 13. At the point where the partial length 12.1, which is connected to the battery casing 1, and the partial length 12.2, which is connected to the motor casing 2, of the air intake pipe 12 are divided, a seal 12.3 is advisably provided, for example, in the form of an inserted O-ring. This air intake pipe 12 is guided up into the channel-like, nozzle-shaped discharge aperture 9; to improve the admission of air, a nozzle mouth 14 oriented in the discharge direction can be provided here within the channel-like region of the discharge aperture 9 so that from the water which flows by at a high speed, air can be drawn in from the outside via the air intake pipe 12 and air is mixed in by the water jet entering the tub filling.

Furthermore, a switch 15 that is accessible from the outside is provided on the battery casing 1, which switch can be formed, for example, by a reed switch arranged in the interior chamber of the battery casing 1 and connected to the wiring of the battery and which is operable via a sliding magnet arranged on the outside of the battery casing 1. As is illustrated by FIG. 1, the battery casing is closed entirely and only provided with contact members 16.1 and 17.1 on its end face facing the motor casing 2, to which contact members corresponding opposite contact members 16.2 and 17.2 are allocated on the corresponding end face of the motor casing 2, which contact members are connected to the motor winding by means of corresponding lines. In the operating state shown, i. e., when the contact members are in contact, the contact members 16.1 and 16.2 as well as the contact members 17.1 and 17.2 respectively form a contact pair 16 or 17 by means of which the battery and motor 5 are connected.

While the motor casing 2 and the pump casing 3 are fixedly connected with one another, the battery casing 1 is detachably connected to the motor casing 2. Here, the connection can be effected via a screw, detent or snap connection which, however, must be embodied such that during the closing of this connection, a defined allocation of battery casing 1 and motor casing 2 takes place and a contact of respectively the two contact members of the contact pairs 16 and 17 as well as of the air intake pipe having a divided embodiment is assured in the proper allocation.

The gap 18 between the battery casing 1 and the motor casing 2, in which gap the two contact pairs 16 and 17 are arranged, must now be sealed so as to be waterproof. This waterproof sealing takes place, on the one hand, by an annular sealing arrangement 19.1 and 19.2 which is connected to the battery casing 1 and respectively surrounds the contact member 16.1 or 17.1 in an annular manner and projects beyond it to the extent that in the operating state shown, in which the battery casing 1 and the motor casing 2 are fixedly connected with one another, the free edge of the annular seals 19.1 and 19.2 is pushed against the end face of the motor casing 2 with corresponding deformation and/or pressing. Thus, the contact pair 16 and the contact pair 17 are each sealed tightly. Additionally, a further seal 20 can be provided in the form of a secondary seal which seals the gap 18 between the battery casing 1 and the motor casing 2 as a whole. Here, it is advisable if, in the region of the separating surface toward the motor casing 2, the battery casing 1 is provided with a circumferential collar 21 which covers the motor casing 2 in a bell-shaped manner so that here an additional protection from penetrating water is provided in that the air from gap 18 cannot escape. The circumferential collar 21 can simultaneously comprise the connecting means between the battery casing 1 and the motor casing 2, which connecting means may be embodied in the shape of pins, lugs, thread attachments or the like.

FIG. 2 illustrates the end face of the battery casing 1 limiting the gap 18 in a plan view. The allocation of the individual components can be taken from the above description and the associated reference numerals. With this design, all components that are subject to wear or use such as the batteries 4, the switch 15 as well as the seals 19 and 20 are connected to the battery casing so that, when the batteries need to be replaced, not only the batteries themselves are replaced but the entire battery casing 1 with all assemblies and attachments, and thus a complete unit with entirely new components is made available to the user.

In a plan view , FIG. 3 illustrates the end face of the motor casing 2 facing the gap 18, which, with the exception of the contact members 16.2 and 17.2, is embodied as a smooth surface and is not provided with any accessory parts. Here, the contact members 16.2 and 17.2 may be embodied in the shape of a button and be made of solid material so that a corrosive layer, which may have formed, can be taken off mechanically. In contrast, the contact members 16.1 and 17.1 on the battery casing can be formed by resilient reeds since the battery casing as a whole must be replaced after a certain period of use.

As is illustrated in the plan view according to FIG. 3 as well as in the associated partial view according to FIG. 4, a corresponding number of L-shaped recesses 22 is arranged on the outside circumference of the motor casing 2; to these recesses are allocated corresponding lugs on the circumferential collar 21 of the battery casing 1 so that the battery casing 1 can be plugged onto the motor casing 2 in the axial direction and be latched together with the motor casing 2 by turning. By way of a non-symmetrical positioning of the recesses 22 as well as of the associated lugs on the collar 21 it is ensured that the battery casing 1 can only be plugged onto the motor casing 2 in a defined allocation. But the connection between battery casing 1 and motor casing 2 may also be embodied in the form of other connection designs, for example, in the form of a multiple thread with end stop notch or also in the form of a straight plug-on snap connection which is to be operated axially.

FIG. 5 illustrates the end face of the motor casing 2 facing the pump casing 3. In the embodiment that is shown, this end face is configured such that it already forms a portion of the pump casing 3. Here, a corresponding attachment 23 projecting beyond the diameter of the motor casing 2 forms that portion of the pump casing embodied as a centrifugal pump which represents a wall of the channel-like, nozzle-shaped discharge aperture 9 and the adjoining portion of the spiral casing. This portion is in direct connection with the air intake pipe 12 via an aperture 24 into which the nozzle mouth 14 may also be inserted during assembly as a separate component.

To make the pump casing 3 complete, the cover element 3.1 shown in corresponding allocation in FIG. 6 must then be placed onto the end face according to FIG. 5. During this process, the cover element 3.1 is advisably fixedly connected with the motor casing 2 by means of bonding, welding or also by a mechanical connection, for example, by means of screws. This embodiment has the advantage that the motor casing 2 may be configured in the shape of a can so that then the motor 5 connected to element 6 configured as end shield, which motor is already connected with the pump impeller 8, can be inserted into the can-shaped casing after making contact with the contact members 16.2 and 17.2 and can be tightly connected with the casing. Here, too, the connection can be accomplished mechanically by means of screws or by way of bonding or welding, optionally by placing a seal in-between. Then, the cover element 3.1 which completes the pump casing 3 is placed onto the motor casing 2 that was assembled in this manner.

For safety reasons, the mouth 25 of the nozzle-shaped discharge aperture 9 must be provided with a protective cover 26. In the embodiment described here, the protective cover may be formed by ribs 27 which are directly formed onto the cover element 3.1 in this region.

In the embodiment described above, the motor 5 is completely encapsulated in the motor casing 2, with the option of providing for a sufficient heat dissipation toward the outside by way of a corresponding design of and/or material selection for the motor casing. This is possible, for example, in that the motor casing 2 is embodied such that the interior surface of its circumferential wall rests tightly against the motor 5 and is provided on the outside surface with corresponding cooling ribs around which washes the tub filling so that a direct heat outflow is possible by way of the material of the motor casing and an overheating of the motor can thus be prevented.

It is also possible, however, to embody the motor casing 2 with a double wall; for the inside wall, a material with good thermal conductivity may be selected, for example, a metal, or the motor may be designed such that the motor jacket, which is necessary anyhow, is already configured as a waterproof casing. The gap created between the inside wall connected with the motor 5 and the outside wall delimiting the casing 2 toward the outside can now be connected to the tub filling via an inlet aperture and be connected to the pump casing via a corresponding intake aperture so that at least a portion of the flow amount which is to be drawn in by the pump impeller is guided along the inside wall and cools the motor in this process.

In a schematic diagram, FIG. 8 illustrates a holding arrangement 28 for the hydromassage device. It is essentially comprised of a holding rail 29 which is angled in the illustrated embodiment and which is secured to the edge 31 of the tub via an upper suction cup 30 and which is secured to the tub wall via a bottom suction cup 32 as holding means. The hydromassage device is then connected to the holding rail 29. For this purpose, the hydromassage device may be provided with a holding claw 33 so that here a detachable connection with the holding rail 29 can be established. Here, the holding claw 33 may be configured such that it forms part of a hinge so that the holding claw is pivotably held on the holding rail 29 by means of a corresponding opposite element 35 via a detachable pivot pin 34. This holding element 35 may be connected to the holding rail 29 in a displaceable and lockable manner so that additional setting options are provided with regard to the height position of the hydromassage device relative to the tub wall.

In order to compensate for different tub slopes, it is advisable for the bottom suction cup 32 to be adjustable with respect to its distance from the holding rail 29 via a corresponding adjustment screw 36 so that the slope of the holding rail 29 vis-a-vis the tub wall can be changed.

The opposite element 35 may also be designed in the form of a crossbeam so that, if the holding claw 33 is embodied accordingly, the hydromassage device is adjustable with respect to the holding rail 29 not only in the vertical but also in the horizontal. This design is suitable particularly for bathtubs with clearly contoured inner walls.

In the simplest embodiment, at least one suction cup can be secured directly on the hydromassage device, which suction cup allows the desired adjustability of the orientation of the hydromassage device relative to the interior space of the tub if need be via a ball joint-type lockable connection between suction cup and hydromassage device.

The holding rail 29 may also be designed as a linear holding rail whose length can be changed in the manner of a telescope, with the holding rail allowing fastening parallel to a tub wall as well as fastening transversely to the longitudinal direction of the tub. Here, the use of suction cups as holding means is also advisable.

In the embodiment indicated in FIG. 8, the air intake pipe 12 integrated into the casing of the hydromassage device is provided at its upper end with an attachment 37 which allows the connection of an extension tube 38. At its free end, this extension tube may be fixed on the tub edge 31, for example, via a suction cup, or at a sufficient height on the tiles of the bathroom wall. The arrangement of an extension tube then allows a free positioning of the hydromassage device in the bathtub. By way of an angled mouth piece on the free end of the extension hose 38 it can be ensured that the water that is pushed through the air intake pipe 12 during the closing of the discharge aperture 9 then does not splash into the bathroom but at most against the tiled wall or into the tub itself.

In its basic layout, the embodiment according to FIG. 9 corresponds to the embodiment according to FIG. 1, but it is designed such that it has a more compact construction. The pump casing 3.1 is fixedly connected with the motor casing 2.1 to form a constructional unit, with the motor casing 2.1 being essentially arranged concentrically but with a small diameter on the pump casing 3.1. The battery casing 1.1 is embodied in the shape of a semicylindrical jacket whose outside circumference corresponds approximately to the outside circumference of the pump casing 3.1 and which extends to the upper side of the casing 3.1. The inside diameter of the semicylindrical jacket, which is open in the bottom section, corresponds approximately to the outside diameter of the motor casing 2.1 so that the constructional unit comprised of motor casing 2.1 and pump casing 3.1 can be inserted with the motor casing 2.1 into the recess of the battery casing 1.1 from below.

At its upper end, the battery casing 1.1 has a cylindrical receiving chamber 39, a sectional view of which is shown in FIG. 9. The switch 15 is arranged in the upper region of this receiving chamber which switch is configured, for example, as a mechanical switch and whose handle 15.1 is covered by an elastic cap 40 which is tightly connected with the upper end of the receiving chamber so that the handle 15.1 of the switch can be operated by deforming the cap 40. The portion of the receiving chamber 39 housing the switch 15.1 is tightly sealed by way of a bottom 41 against the insertion aperture oriented downward, with the bottom having the contact members 16.1 and 17.1 on its outer side. The switch 15 may also be arranged on the front end of the motor casing 2.1 in a corresponding configuration, as is indicated with dash-dot lines in FIG. 9.

Now, the small-diameter plug end 2.2 of the motor casing 2.1 is plugged into the open, free end 42 of the receiving chamber 39. The plug end is provided with the seal 19, for example, in the form of an O-ring so that the open end 42 of the receiving chamber 39 is sealed so as to be waterproof in the region of the contact members. At its end faces, the plug-in end 2.2 of the motor casing 2.1 is provided, in turn, with corresponding contact members 16.2 and 17.2 so that, in the plugged-in state, the electrical connection is produced by the contact pairs 16.1, 16.2 and 17.1, 17.2, respectively.

In the sealed region of the receiving chamber 39, the contact pairs can respectively be arranged, on the one hand, on the inside circumference of the wall of the receiving chamber and, on the other hand, on the outside circumference of the plug-in end 2.2.

As is indicated by the dash-dot line in FIG. 1, the motor casing 2.1 may be configured to be double-walled, with the inner wall being embodied in the form of an inside casing 48 extending up into the interior chamber of the pump casing 3.1. In the embodiment indicated, the inside casing 48 in this region simultaneously forms the inner wall of the pump casing and the end shield 6. Here, the inside casing 48 is made of a material having good thermal conductivity, for example, of aluminum. Thus, it becomes possible to remove the heat generated by the dissipated energy of the motor by means of the water flowing through the pump casing. This has advantages compared to a double-walled embodiment in which the water is drawn in by the pump through a gap. During this process, deposits may form in the gap.

The plug-in end 2.2 of the motor casing 2.1 is provided with projecting pins 43 engaging correspondingly shaped grooves on the inside wall of the free, open end 42 of the receiving chamber 39 and forming a bayonet lock or a snap lock with these grooves.

If the batteries are to be charged, the bayonet lock is released and the battery casing 1.1 is pulled off of the device portion and a charging plug provided with its insert 2.2 corresponding to the motor casing 2.1 is plugged into the receiving chamber 39 so that, again, the corresponding contact pairs are in contact with one another and the batteries disposed in the battery casing can be charged. If two battery casings are provided for each unit, one set of batteries can be charged while the other set of batteries is available for the bathing operation. As is shown in FIG. 1, the battery casing 1 is provided with a ventilation aperture 49 which is closed by a diaphragm 50 which is impermeable to water, but permeable for gas.

The air intake pipe 12 is formed onto the outside of the battery casing 1.1 and is guided up to the upper outside wall 44 of the pump casing 3.1 and ends there in an aperture which is not shown in detail and which is connected with the nozzle-type discharge aperture 9 so that, from the water flowing by at a high speed, air is drawn in through the aperture via the air intake pipe and air is mixed into the water jet entering the tub filling. In this embodiment, the nozzle-type discharge aperture 9 is embodied in the form of a short nozzle pipe which is pivotably seated in the pump casing 3.1 via a spherical body 9.1. Here, a seal between the discharge end of the air intake pipe 12 and of the air intake aperture in the pump casing 3.1 can be dispensed with if the end of the air intake pipe 12 is guided close to the outside wall 44 of the pump casing 3.1.

The central intake aperture 10 in the pump casing 3.1 is shielded toward the bottom by a cover plate 45 arranged at a distance from the outside wall of the pump casing 3.1 so that the water is drawn in through the circumferential slot formed in this manner. In the region of the supports 46 for the cover plate 45, this slot may also be provided with a strainer, not shown in detail, to prevent the risk of drawing in hair.

Advisably, the central discharge aperture 10 may also be provided with an axial discharge piece having a fixed, socalled hair trap on the inside. In this case, it is advisable that a detachable trap cover be placed onto the mouth end of the discharge piece, which trap cover is provided with a circumferential collar at its outside circumference.

As is shown in the plan view according to FIG. 10 and the rear view according to FIG. 11, an attachment 47 is disposed in the rear region of the battery casing 1.1; the attachment is provided with a groove-like holding rail 29 into which a suction cup 32 can be inserted so that the device can be secured on the inside wall of the bathtub.

I claim:

1. A hydromassage device for use in a bathtub, said device having a pump casing which is connected to at least one intake aperture and to at least one nozzle-shaped discharge aperture, a pump impeller seated in said casing, a motor casing in which an electric drive motor is arranged, said drive motor being connected to said pump impeller, and further having a battery casing in which electrical batteries are arranged which are connected to the drive motor, said pump casing, said motor casing and said battery casing being connected with one another and at least one of said casings being provided with holding means for securing said device to a wall of the bathtub, characterized in that said battery casing and said motor casing are each formed by separate, waterproof casings having an outside wall, said outside walls are detachably connected with one another, said outside wall of said battery casing and said outside wall of said motor casing are respectively provided with a pair of electrical contact members which are in contact with one another when, in the operating state, both casings are connected with one another and which respectively form a contact pair with which the batteries and the drive motor are connected, sealing means being arranged around said contact pairs so as to prevent water from reaching said pairs.

2. The hydromassage device according to claim 1, wherein the sealing means are configured for sealing each contact pair by itself.

3. The hydromassage device according to claim 1, wherein the battery casing defines a receiving chamber having an open end region and a closed end region, the contact members of the battery casing being arranged in the closed end region of the receiving chamber, the contact members of the motor casing being insertable into the receiving chamber and being adapted to be interlocked therewith.

4. The hydromassage device according to claim 3, wherein the receiving chamber, at least at the closed end region thereof, and the motor casing, at least at a region thereof allocated to the open end region of the receiving chamber, are cylindrical, the device further comprising a seal active between the receiving chamber and the motor casing.

5. The hydromassage device according to claim 1, further comprising a latch connection connecting the battery casing and the motor casing with one another.

6. The hydromassage device according to claim 1, wherein at least the motor casing includes an air intake pipe which ends in a region of the nozzle-shaped discharge aperture.

7. The hydromassage device according to claim 6, wherein the air intake pipe is guided on an outside region of the battery casing and is divided in a connecting region between the motor casing and the pump casing.

8. The hydromassage device according to claim 7, further comprising a sealing arrangement for sealing a dividing region of the air intake pipe against an outside region of the air intake pipe in an operating state of the device.

9. The hydromassage device according to claim 1, wherein the pump casing includes two sections, one of the sections being connected in a material-to-material bonding arrangement with the motor casing.

10. The hydromassage device according to claim 1, wherein the pump casing is pivotable relative to the motor casing in a rotary plane of the pump impeller.

11. The hydromassage device according to claim 1, further comprising a holding rail, the holding means including a suction cup connected via the holding rail to one of the battery casing and the motor casing.

12. The hydromassage device according to claim 11, wherein said one of the battery casing and the motor casing is detachably connected to the holding rail.

13. The hydromassage device according to claim 11, wherein said one of the battery casing and the motor casing is connected to the holding rail so as to be movable relative thereto.

14. The hydromassage device according to claim 11, wherein the holding rail includes a telescoping structure such that a length thereof is changeable.

15. The hydromassage device according to claim 1, further comprising a switch disposed on one of the battery casing and the motor casing.

16. The hydromassage device according to claim 1, wherein the motor casing is at least partially double-walled and includes an inner wall connected to the motor and an outer wall defining an inlet aperture therein connected to the pump intake.

17. The hydromassage device according to claim 1, wherein the motor casing is at least partially double-walled and includes an inner wall configured as an inside casing made of a material having a relatively high thermal conductivity and extending into an interior chamber of the pump casing.

18. The hydromassage device according to claim 17, wherein the inside casing simultaneously forms at least a portion of an inner wall of the pump casing.

19. The hydromassage device according to claim 1, wherein the battery casing defines a ventilation aperture and includes a diaphragm covering the ventilation aperture, the diaphragm being permeable to gas and impermeable to water.

* * * * *